US006293114B1

(12) United States Patent
Kamemoto

(10) Patent No.: US 6,293,114 B1
(45) Date of Patent: Sep. 25, 2001

(54) REFRIGERANT MONITORING APPARATUS AND METHOD

(75) Inventor: Derek Y. Kamemoto, Seattle, WA (US)

(73) Assignee: Red Dot Corporation, Seattle, WA (US)

( * ) Notice: Subject to any disclaimer, the term of this patent is extended or adjusted under 35 U.S.C. 154(b) by 0 days.

(21) Appl. No.: 09/584,204

(22) Filed: May 31, 2000

(51) Int. Cl.[7] ..... F25B 49/02
(52) U.S. Cl. ..... 62/129; 62/126
(58) Field of Search ..... 62/125, 126, 129, 62/130, 208, 209, 203, 226, 227

(56) References Cited

U.S. PATENT DOCUMENTS

| | | | |
|---|---|---|---|
| 4,167,858 | 9/1979 | Kojima et al. | 62/126 |
| 4,577,469 | 3/1986 | Okura | 62/126 |
| 4,586,828 | 5/1986 | Winter et al. | 374/16 |
| 4,660,026 | 4/1987 | Chandler | 340/604 |
| 4,757,693 | 7/1988 | Charriau et al. | 62/126 |
| 4,987,749 | 1/1991 | Baker | 62/222 |
| 5,009,074 | 4/1991 | Goubeaux et al. | 62/115 |
| 5,009,076 | 4/1991 | Winslow | 62/129 |
| 5,144,814 | 9/1992 | Gaudette | 62/225 |
| 5,150,584 | 9/1992 | Tomasov et al. | 62/209 |
| 5,152,152 | 10/1992 | Brickner et al. | 62/126 |
| 5,197,298 | 3/1993 | Kobayashi et al. | 62/115 |
| 5,249,431 | 10/1993 | Kuribara et al. | 62/129 |
| 5,251,453 | 10/1993 | Stanke et al. | 62/126 |
| 5,301,514 | 4/1994 | Bessler | 62/126 |
| 5,335,513 | 8/1994 | Campbell et al. | 62/228.3 |
| 5,398,516 | 3/1995 | Kuribara et al. | 62/129 |
| 5,457,965 | 10/1995 | Blair et al. | 62/129 |
| 5,522,231 | 6/1996 | Kenyon et al. | 62/129 |
| 5,586,445 | 12/1996 | Bessler | 62/126 |
| 5,647,222 | 7/1997 | Sarakinis | 62/129 |
| 5,660,052 | 8/1997 | Kenyon et al. | 62/228.3 |
| 5,691,466 | 11/1997 | Lawrence et al. | 73/29.05 |
| 5,713,213 | 2/1998 | Nobuta et al. | 62/126 |
| 5,778,695 | 7/1998 | Ring et al. | 62/218 |
| 5,934,087 | 8/1999 | Watanabe et al. | 62/126 |
| 5,987,903 | 11/1999 | Batha | 62/129 |

*Primary Examiner*—Harry B. Tanner
(74) *Attorney, Agent, or Firm*—Joan H. Pauly

(57) ABSTRACT

Apparatus for monitoring a refrigerant state in a refrigeration system includes a charge sensor and a controller. The sensor is positioned adjacent to the outlet of an evaporator. The sensor produces a voltage output signal in response to an input signal from the controller. The controller compares the output signal to a predetermined set point chosen to correspond to a predetermined refrigerant state. The sensor is preferably a self-heated thermistor positioned adjacent to flow exiting the evaporator through the outlet. The controller preferably compares the output signal to a set point at preset intervals and computes an average for a predetermined time duration. This helps to avoid false readings due to transitory conditions. The apparatus may be used in various types of refrigeration systems but is contemplated to be used primarily in mobile air conditioning systems in order to detect a reduced refrigerant charge in such systems. In such applications, the input signal is preferably an at least substantially constant voltage applied to a voltage divider circuit. Input from elements in addition to the charge sensor may be used to enhance the accuracy of detection.

58 Claims, 5 Drawing Sheets

POWER ON
CLUTCH ON ?
NO
YES
READ CHARGE SENSOR INPUT
CALCULATE SET POINTS
COMPUTE DIFFERENCE
WEIGHT DIFFERENCE
COMPUTE RUNNING AVERAGE
VERY LOW CHARGE ?
YES
DISENGAGE CLUTCH
VERY LOW CHARGE WARNING
NO
LOW CHARGE ?
YES
LOW CHARGE WARNING
NO

REFRIGERANT MONITORING APPARATUS AND METHOD

TECHNICAL FIELD

This invention relates to apparatus and a method for monitoring a refrigerant state in a refrigeration system and, more particularly, to apparatus and a method in which a charge sensor is positioned adjacent to the outlet of an evaporator and sends a voltage output signal to a controller in response to an input signal from the controller, and in which the controller compares the output signal to a predetermined set point chosen to correspond to a predetermined refrigerant state.

BACKGROUND INFORMATION

As used herein, the term "refrigeration system" includes mobile air conditioning systems, such as automotive, heavy trucking, agricultural, construction, and mining equipment air conditioning systems; stationary air conditioning systems; stationary refrigeration equipment, such as refrigeration and freezer containers and storage refrigerators and freezers; and building heating ventilation and air conditioning systems. A typical refrigeration system includes an evaporator, a compressor, a condenser, and an expansion device. The system may also include additional devices to enhance the functioning of the system. Commonly found devices in refrigeration systems include thermostats, pressure sensors, and switches to engage and disengage components of the system to enhance system performance and/or prevent damage due to system operation under undesirable conditions.

In a refrigeration system, a refrigerant circulates through the system. The evaporator absorbs heat from the area to be cooled, which causes the refrigerant in the evaporator to boil off into a gaseous state. The refrigerant flows from the evaporator outlet to a compressor, in which the refrigerant is pressurized to a high pressure condition. From the compressor the refrigerant circulates first to a condenser, where the refrigerant is cooled to a liquid state, and then to an expansion device, in which the pressure drops down to a low pressure. From the expansion device, the refrigerant circulates back to the evaporator, and the cycle is repeated. Efficient and safe operation of the system requires that proper refrigerant circulation and an appropriate refrigerant charge level be maintained.

It is well known that operating an air conditioning system at a low refrigerant charge condition can cause serious problems. These problems include damage to the compressor due to reduced lubricant circulation since the circulating refrigerant normally carries the lubricant. The problems also include compressor leaks or damage due to low or negative suction pressures, premature compressor clutch failure due to rapid clutch actuation, reduction in fuel economy, loss of air conditioning cooling performance, and operator annoyance. In addition, where the low charge condition is a result of an air conditioning system leak, the condition presents the problem of undesirable emission of refrigerant gases into the environment.

Historically, there have been many difficulties associated with the reliable detection of refrigerant charge levels in mobile air conditioning systems. Because of the wide range of possible operating conditions, both static and dynamic, a low charge state under a particular set of operating conditions looks identical to a full charge state under a different set of operating conditions. Therefore, even devices that appear to function in most cases will sometimes generate unacceptable false low charge alarms. Most known detection systems use a combination of two or more temperature sensors, pressure switches, or pressure transducers. Those that do not tend to be particularly unreliable.

BRIEF SUMMARY OF THE INVENTION

The present invention uses a combination of a charge sensor and a controller to monitor a refrigerant state in a refrigeration system having an evaporator with an outlet.

According to an aspect of the invention, apparatus for monitoring the refrigerant state includes a charge sensor positioned adjacent to the outlet of the evaporator. A controller is electrically connected to the sensor to provide an input signal to the sensor. The sensor produces a voltage output signal in response to the input signal. The controller receives the output signal, processes it, and compares it to a predetermined set point chosen to correspond to a predetermined refrigerant state.

The preferred form of the charge sensor is a self-heated thermistor. In the currently preferred embodiments, the sensor is a self-heated NTC type thermistor. The positioning of the sensor may be varied. Preferably, it is mounted as close as physically possible to the exit of the evaporator outlet. It may be positioned in the stream of refrigerant flow, adjacent to the flow or set back from the flow. Currently, it is preferred that the thermistor be positioned adjacent to the flow exiting the evaporator through the outlet. The optimal position is currently believed to be one in which the sensor is placed radially around the evaporator outlet at about 90° to vertical.

The controller preferably compares the output signal to the set point at preset intervals and computes an average for a predetermined time duration. This averaging of the signal over a period of time helps to prevent incorrect indications of the refrigerant state due to transitory conditions.

The input signal from the controller to the sensor may take various forms. In a first embodiment, the controller applies an at least substantially constant current to a circuit interconnecting the controller and the charge sensor. In a second embodiment, the input signal is a voltage varied to maintain a constant temperature of the thermistor. In a third embodiment, the controller applies an at least substantially constant voltage to a voltage divider circuit to drive the charge sensor. The choice of the type of input signal is determined at least partially on the basis of the purpose for monitoring the refrigerant state in a particular system.

It is currently anticipated that the method and apparatus of the invention will be used primarily for detecting a reduced refrigerant charge. According to an aspect of the invention, the apparatus includes a charge sensor positioned adjacent to the outlet of the evaporator, and a controller electrically connected to the sensor to provide an input signal thereto. The sensor produces a voltage output signal in response to the input signal. The controller receives the output signal, processes it, and compares it to a predetermined set point chosen to correspond to a predetermined refrigerant state indicative of a reduced refrigerant charge.

The apparatus for detecting a reduced refrigerant charge may include one or more of the preferred or alternative features discussed above. When the purpose is to detect a reduced refrigerant charge, the alternative of a voltage divider circuit to which a substantially constant voltage is applied is the preferred option for the input signal from the controller.

Preferably, the controller compares the output signal to a first predetermined set point to determine whether a low charge condition exists. It also compares the output signal to a second predetermined set point to determine whether a very low charge condition exists. This feature allows different warnings or signals to be produced by the controller in response to conditions that the operator should be aware of but that do not present an immediate danger of damage to the system, and conditions that do present a danger of immediate damage. For example, for the former case, a warning signal may be produced. For the latter case, the controller can produce a signal which causes a component of the refrigeration system to cease operation.

One of the major advantages of the apparatus and method of the invention is that they permit determination of a low charge condition on the basis of output from a single charge sensor. Systems which make the determination on the basis of the single charge sensor described above provide significantly improved performance over known systems and, thus, accomplish a major goal of the invention. However, this improved performance can be further enhanced by use of additional elements. For example, the apparatus may further comprise a high pressure side pressure transducer. The controller receives a pressure signal from the transducer and uses the pressure signal to calculate a correction factor to shift the voltage output signal from the charge sensor to improve reliability of detection of a reduced refrigerant charge. This use of a pressure signal to improve reliability does not have any significant effect on the simplicity of the method and apparatus under most circumstances. High pressure side pressure transducers are commonly found in refrigeration systems for purposes other than detection of a reduced refrigerant charge.

According to a method aspect of the invention, a method of detecting a reduced refrigerant charge in a refrigeration system having an evaporator with an outlet is provided. The method comprises positioning a charge sensor adjacent to the outlet of the evaporator and electrically connecting the sensor to a controller. An input signal is sent from the controller to the sensor to cause the sensor to produce a voltage output signal. The output signal is sent from the sensor to the controller. In the controller, the output signal is compared to a predetermined set point chosen to correspond to a predetermined refrigerant state indicative of a reduced refrigerant charge. The method may include one or more of the preferred and alternative features discussed above in connection with the apparatus of the invention.

As discussed above, the invention encompasses apparatus and a method for detecting reduced refrigerant charge. It also relates to an air conditioning system incorporating such apparatus. According to an aspect of the invention, the system comprises a refrigerant circulation circuit and apparatus for detecting a reduced refrigerant charge. The circuit includes an evaporator with an outlet, a compressor downstream of the outlet, a condenser downstream of the compressor, and an expansion device between the condenser and the evaporator. The detecting apparatus includes a charge sensor positioned adjacent to the outlet of the evaporator. It also includes a controller electrically connected to the sensor to provide an input signal thereto. The sensor produces a voltage output signal in response to the input signal. The controller receives the output signal, processes it, and compares it to a predetermined set point chosen to correspond to a predetermined refrigerant state indicative of a reduced refrigerant charge. The system may also include one or more of the preferred or optional features discussed above.

The invention provides an improved air conditioning system and improved reliability and accuracy in the monitoring of a refrigerant state in a refrigeration system. When such monitoring is for the purpose of detecting a reduced refrigerant charge, the invention is highly reliable in avoiding undesirable false low charge warnings or failures to detect actual reduced refrigerant charge conditions. The invention accomplishes these advantageous goals with minimal complication of the refrigeration system. The elements that are included in the basic invention apparatus and are used in the basic method of the invention are the simple combination of a single charge sensor and a controller. These two elements alone achieve the goal of the invention to improve the monitoring of a refrigerant state. However, as discussed above, the functioning of the apparatus may be further improved and optimized by use of additional elements. These additional elements may be elements of the refrigeration system that are commonly already present, such as the pressure transducer described above.

BRIEF DESCRIPTION OF THE DRAWINGS

In the drawings, like element designations refer to like parts throughout, and.

DETAILED DESCRIPTION OF THE INVENTION

The invention provides apparatus and a method for monitoring a refrigerant state in a refrigeration system. Currently, it is anticipated that the primary purpose of the monitoring will be to detect a reduced refrigerant charge in the refrigeration system. The detection of a reduced charge is signaled to the system so that action may be taken to avoid the problems discussed above created by low refrigerant charge conditions. The information obtained from the monitoring may also be used for purposes other than detecting a reduced refrigerant charge. For example, it may be used in controlling one or more system devices.

Figure 1:
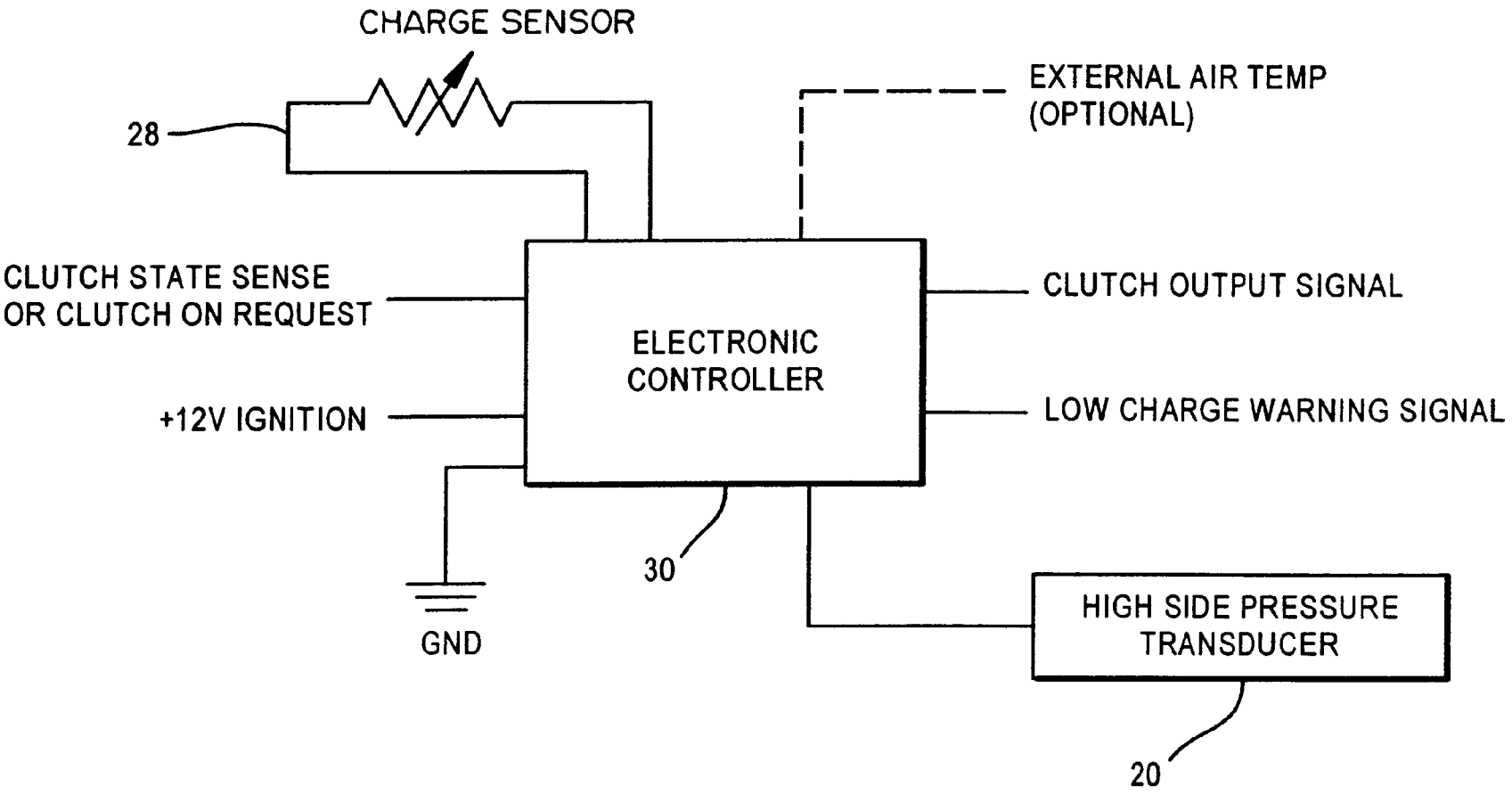
FIG. 1 is a schematic diagram of a preferred embodiment of the controller and the inputs thereto and outputs therefrom.
Figure 2:
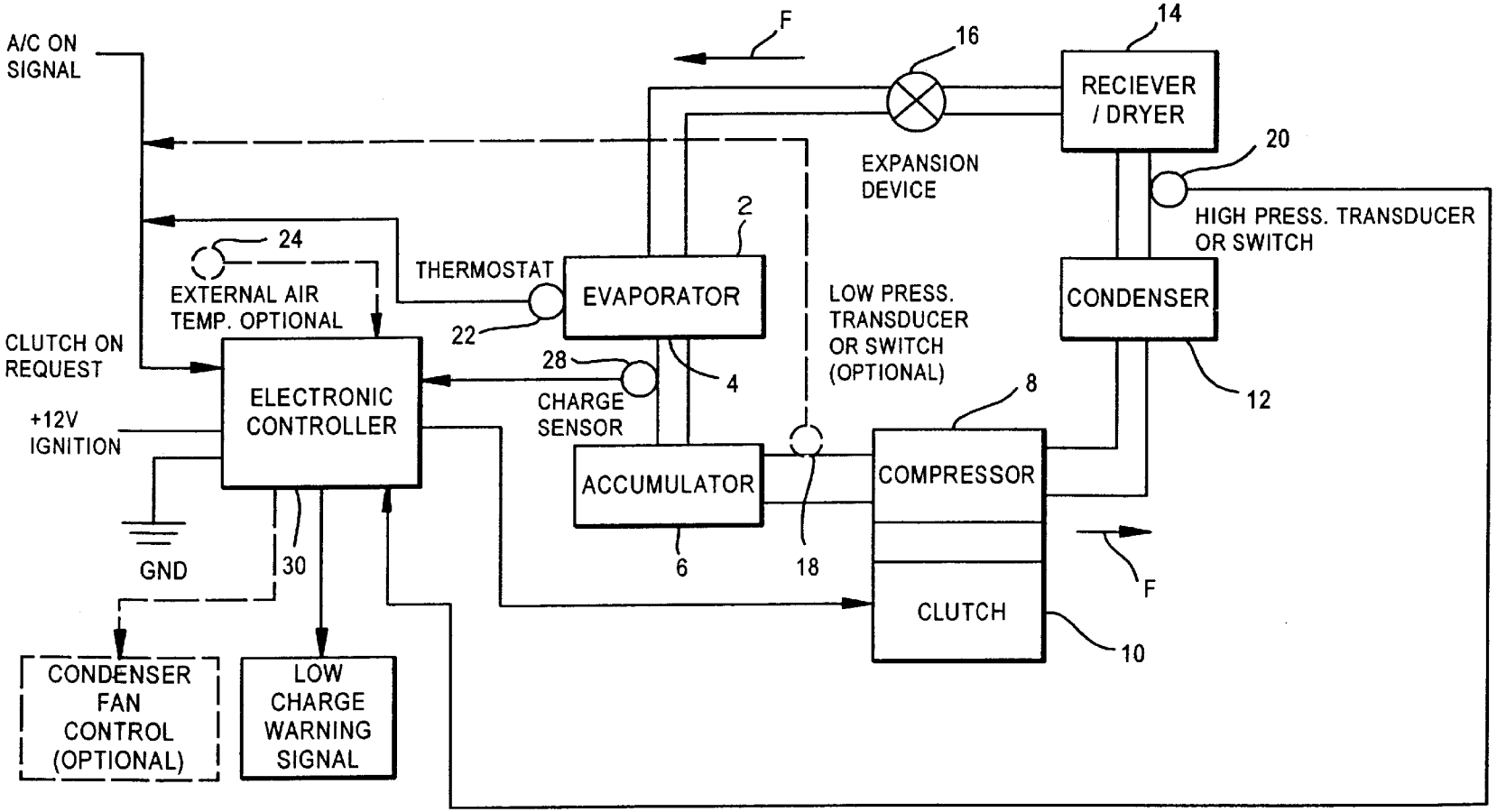
FIG. 2 is a system diagram of a refrigeration system into which the apparatus of FIG. 1 is incorporated.
Figure 3:
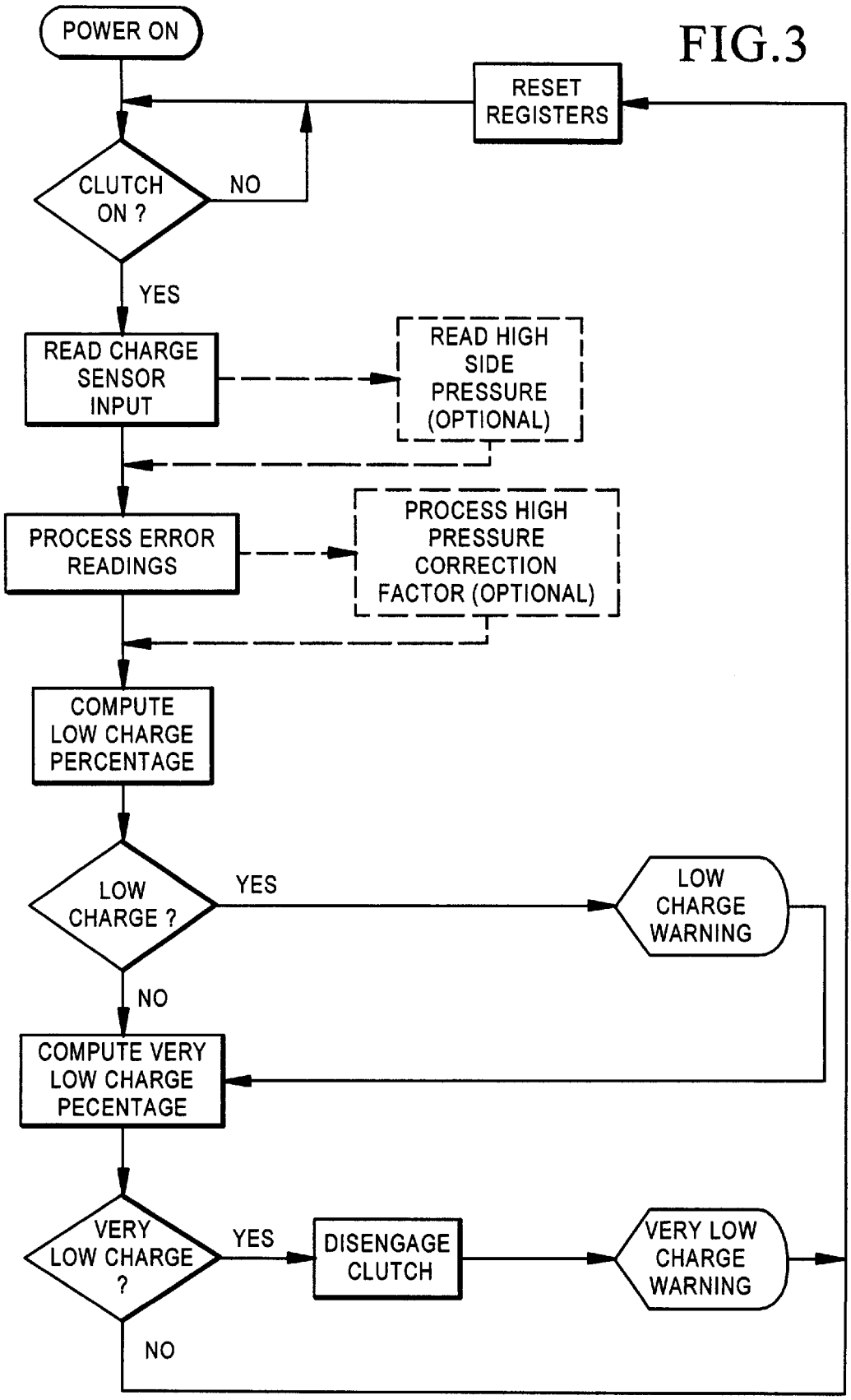
FIG. 3 is a flow diagram of the operation of the illustrated preferred embodiment.
Figure 4:
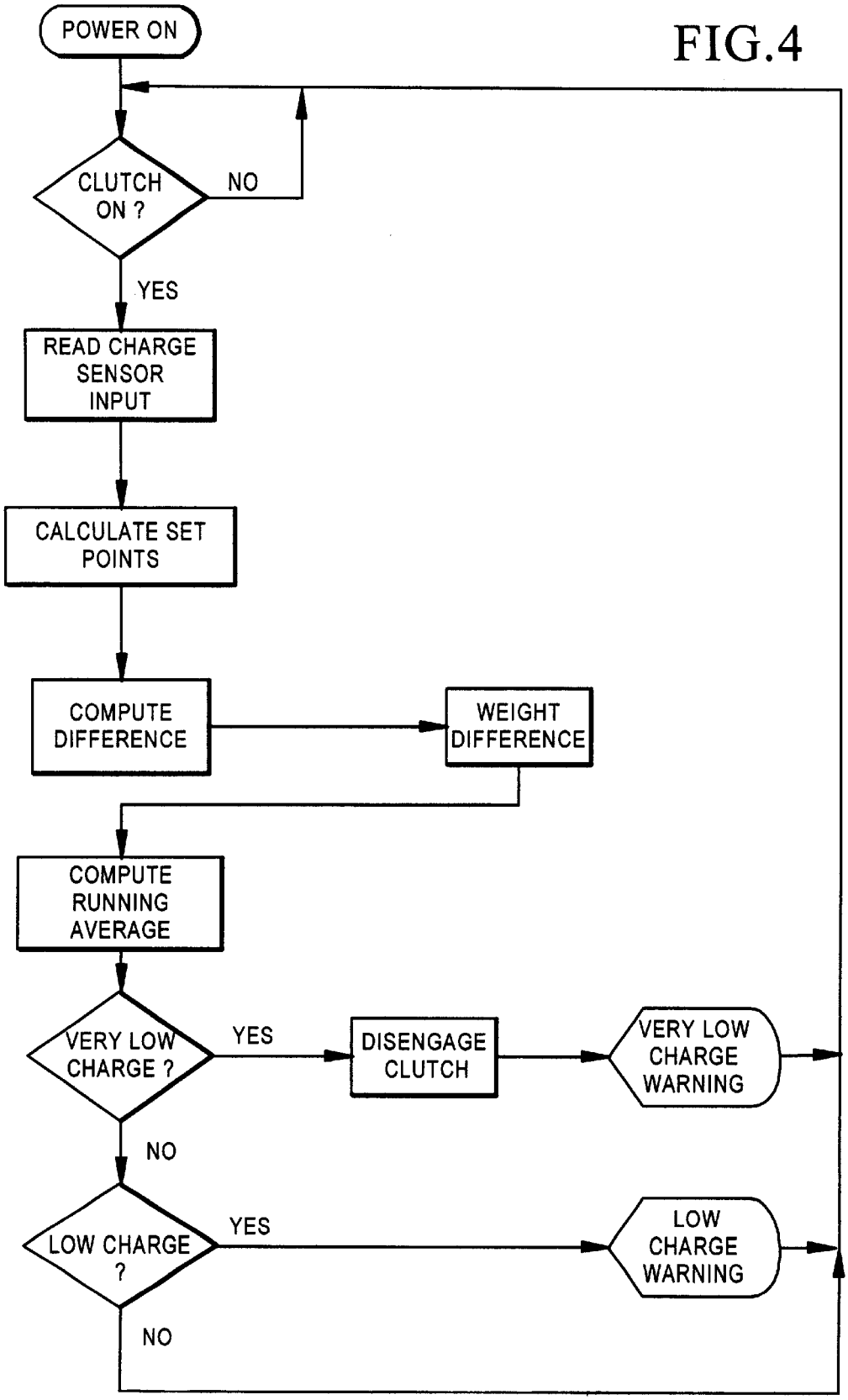
FIG. 4 is like FIG. 3 except that it illustrates the operation of a modified embodiment of the invention.
Figure 5:
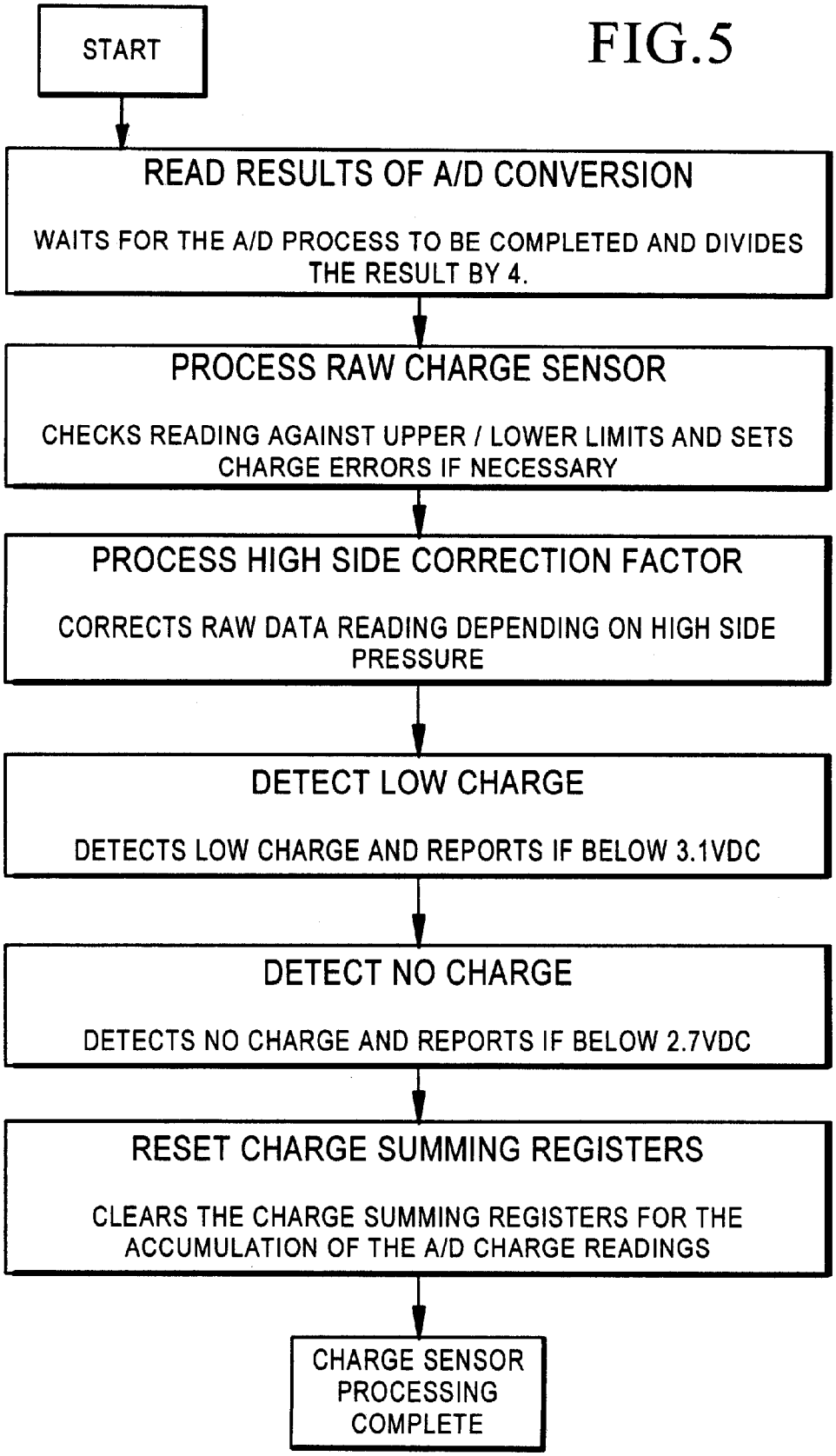
FIG. 5 is a flow chart illustrating the processing of charge sensor data in the embodiment illustrated in FIGS. 1–3.

The drawings illustrate the preferred embodiments of the invention. The embodiment shown and illustrated in FIGS. 1–3 and 5 is constructed according to the invention and also constitutes the best mode for carrying out the invention to detect reduced refrigerant charge currently known to the applicant. FIG. 2 illustrates an air conditioning system into which the detection apparatus of the invention is incorporated and which may be used to practice the method of the invention. FIGS. 1, 3, and 5 illustrate the incorporation of the controller of the invention into the system and the operation of the controller. FIG. 4 illustrates the operation of a modified controller.

Referring to FIG. 2, the basic elements of the detection apparatus of the invention, a charge sensor 28 and a controller 30, are incorporated into an air conditioning system which also includes a number of standard air conditioning system components. Refrigerant circulates through the components to cool a desired area in a known manner. The arrows F in FIG. 2 indicate the direction of flow.

The air conditioning system components include an evaporator 2 having an outlet 4. Refrigerant flows from the evaporator 2 to a compressor 8. The refrigerant exiting the evaporator 2 through the outlet 4 is typically primarily, but not entirely, gaseous. Since it is undesirable for liquid refrigerant to enter the compressor 8, an accumulator 6 is provided between the evaporator outlet 4 and the compressor 8 to evaporate any remaining liquid refrigerant. Operation of the system is commenced and discontinued by engagement and disengagement of a compressor clutch 10. The clutch 10 can be controlled manually by an operator or automatically in response to signals from other portions of the system. From the compressor 8, the refrigerant flows to a condenser 12, from which it flows to an expansion device 16 through a receiver/dryer 14. The receiver/dryer 14 provides a reservoir for surplus refrigerant and includes a desiccant to remove water vapor from the refrigerant. The expansion device 16 may take various forms, for example, a thermal, variable orifice, dual fixed orifice, electronically controlled, or other type of expansion valve; a fixed orifice; or a capillary expansion tube. From the expansion device 16, the refrigerant flows back to the evaporator 2.

The system shown in FIG. 2 also includes a number of additional components commonly found in air conditioning systems. These components include an optional low pressure transducer or switch 18. This element is positioned in the low or suction side of the system to protect the system from low or negative pressures in the low or suction side. As shown, output from the element 18 is communicated to the on/off portion of the system to allow system operation to be discontinued in response to the output.

A second additional component shown in FIG. 2 is a high pressure transducer or switch 20. Such an element is commonly used to protect the system from high pressure by disengaging the clutch 10 to stop operation of the compressor 8. In the illustrated embodiment of the air conditioning system incorporating the apparatus of the invention, the element 20 is also used in the detection of a reduced or low refrigerant charge condition. Therefore, output from the element 20 is communicated directly to the controller 30 rather than to the on/off portion of the system, where it is normally communicated in known systems. In the preferred operation of the system shown in FIG. 2, output from the element 20 is also used for the conventional pressure limiting function and to control the condenser fan and prevent operation under low temperature conditions.

A third component shown in FIG. 2 is an evaporator thermostat 22. This is used for the conventional purpose of preventing formation of ice on the evaporator by disengaging the clutch at a predefined temperature. It may also be used to control the temperature of the cooled output air.

A fourth component is the external air temperature sensor 24. This element is optional for use in the system of the invention. It performs the conventional purpose of preventing operation of the system at external air temperatures exceeding predefined limits. When used with the apparatus of the invention, it may also be used to provide additional information to the controller 30. Output from the sensor 24 is optionally used by the controller 30 to shift the low charge and very low charge set points up or down depending on the ambient temperature. This reduces the dependence of the detection on evaporator and condenser loading. For low ambient temperatures, the charge detection set points are shifted down, and for high ambient temperatures, the set points are shifted up, according to a non-linear function which weights more shifting toward higher temperatures. The particular set point shifting functions are determined for a particular system by testing.

Referring to FIGS. 1 and 2, the electronic controller 30 of the illustrated embodiment of the invention is a microprocessor controlled electronics module. The controller 30, coupled with the charge sensor 28 and the standard air conditioning system components described above, is used to detect the presence or lack of refrigerant in the air conditioning circuit. Software, which may be embedded in the microprocessor, takes raw output from the charge sensor 28 and produces an accurate determination of the system refrigerant level independent of dynamic fluctuations in the operating air conditioning system. The controller 30 detects the level of refrigerant charge in the system while the system is running. It warns the operator, by way of a visual or a data signal, if the charge level is low. If the charge level drops to a point low enough to cause potential system damage, the controller 30 disengages the system via the compressor clutch 10.

The charge sensor 28 may take various forms but is preferably a self-heated thermistor. In its currently preferred form, the charge sensor 28 is a self-heated NTC type thermistor. The sensor 28 is mounted in or around the refrigerant flow as close as physically possible to the outlet 4 of the evaporator 2. It is presently believed that the effectiveness of the sensor 28 decreases as a function of distance away from the immediate outlet 4 of the evaporator 2. The sensor 28 may be positioned in the stream of the refrigerant flow, adjacent to the flow, or set back from the flow. The adjacent positioning with the sensor 28 placed radially around the evaporator outlet 4 at 90° to vertical is currently preferred as optimal. The sensor 28 is electrically connected to the controller 30 to receive an input signal therefrom and communicate an output signal thereto.

As noted above, the detecting of the refrigerant charge state in a mobile air conditioning system is very difficult. Therefore, even minor changes in detection apparatus and methods can have a large effect on performance. Thus, the positioning of the charge sensor 28 close to the evaporator outlet 4 is considered a critical characteristic of the invention. A low charge condition is characterized by a lack of liquid refrigerant at the exit 4 of the evaporator 2 and a highly superheated condition of the refrigerant vapor at the same location. The invention uses the output from the charge sensor 28 as an indication of the refrigerant state at the outlet 4. Refrigerant state may be entirely liquid, entirely gaseous, or a combination of liquid and gaseous. As noted above, the state at the evaporator outlet 4 is typically primarily but not entirely gaseous. The invention detects a condition in which the liquid component of the refrigerant flow drops below acceptable levels.

FIGS. 3 and 5 illustrate the operation of what is currently the most preferred embodiment of the invention. When the system is turned on and the controller 30 is powered, the controller 30 energizes the charge sensor 28 by applying a constant voltage to the sensor 28 through a voltage divider circuit. The circuit is designed so that the input voltage to the circuit remains constant while the current is allowed to fluctuate as a function of the resistance of the thermistor 28. The effect of the circuit, which electrically interconnects the controller 30 and sensor 28, is to drive the output signal from the sensor 28 to detect a lack of refrigerant charge or a condition of sufficient charge. Referring to FIG. 3, the controller 30 disregards the output from the sensor 28 if the compressor clutch 10 is disengaged, i.e. if the air conditioning system is not running. The determination as to the state of the clutch 10 can be made internally if the controller 30 is the sole controlling device for engaging the clutch 10. An external clutch sense input is incorporated in systems where other system components can control the state of the clutch 10. Such other system components may be, for example, electronic engine control computers, automatic temperature control units, pressure switches, or thermostats.

As illustrated in FIG. 5, the controller 30 applies a constant voltage to the sensor 28 through the voltage divider circuit. Other types of input to the sensor 28 may also be used. However, the constant voltage input is currently preferred for the detection of low refrigerant charge. Other types of circuits for applying different types of inputs include a constant current circuit or a constant thermistor temperature circuit. For the latter type of circuit, the signal from the controller 30 is a variable voltage that is varied in a manner to maintain a constant temperature of the thermistor sensor 28. In each case, the input signal self-heats the thermistor to cause a thermistor output to the controller 30 that is a measure of a quantity related to the heat transfer between the thermistor 28 and the surrounding refrigerant. The quantity of heat transfer corresponds to the refrigerant state.

FIG. 3 illustrates the overall operation of the controller 30 to accomplish the low charge detection procedure. FIG. 5 illustrates the processing of the signal from the charge sensor 28 in more detail. Referring to FIG. 3, once the system has been turned on and engagement of the clutch has been verified, the controller 30 reads the charge sensor input. This input is a voltage output signal produced by the sensor 28 in response to the input signal from the controller 30. The controller 30 receives the signal from the sensor 28 and processes it. As part of the processing, the controller 30 uses input from the high pressure side transducer 20 to adjust the input from the sensor 28.

To eliminate or at least reduce the effect of transient conditions, the controller 30 compares the output signal from the sensor 28 to one or more set points at preset intervals. As shown in FIG. 4, the controller computes an average for a predetermined time duration. The set points are chosen to correspond to a predetermined refrigerant state. The preset intervals may, for example, be about one-tenth of a second. Shorter intervals can be used if desired and if the controller 30 has sufficient memory. For the detection of a low charge condition, a running average time duration of about 40 to 120 seconds is used. For a very low charge condition at a low enough level to create a danger of system damage, the running average time duration is about 30 to 60 seconds. Longer time durations can be used to increase confidence in accurate charge level detection, but have the drawback of a possible decrease in timely detection. Longer time durations may be chosen, for example, to be used in systems that are subject to particularly long or severe transient conditions. As shown in FIG.3, a low or very low charge condition is detected when more than 95% of the readings during a time duration are less than the applicable set point.

It is currently preferred that the set point for the low charge condition and the set point for the very low charge condition be predetermined for the particular refrigeration system prior to use of the system. The predetermination is made by a testing procedure. When a very low charge is detected, the controller 30 sends a signal that causes the compressor clutch 10 to be disengaged and issues a very low charge warning to the operator. For a low charge condition, the controller 30 does not discontinue operation of the system but does provide a warning to the operator. In the embodiment illustrated in FIGS. 3 and 5, a low charge is detected when the charge is about 50% or less at 100° F. A very low charge detection occurs at about 30% or less at 100° F.

As noted above, FIG. 5 illustrates the processing of the voltage output signal from the charge sensor 28 by the controller 30. When it enters the controller 30, the signal is converted from a raw electrical signal into digital form. The converted signal is checked against preset upper and lower limits to determine if there is a sensor fault, i.e. if the sensor is either disconnected or shorted. If a fault is detected, a flag is set so that the signal from the sensor 28 is disregarded. If the signal is within acceptable limits, the signal is shifted in accordance with a preferred feature of the invention. The sensor data from the high side pressure transducer 20 is used by the controller 30 to determine whether and how much the sensor signal should be shifted. The transducer 20 measures the pressure on the liquid refrigerant on the high pressure side of the refrigerant circuit. This input is not necessary for charge detection within the scope of the invention. However, it improves the reliability of detection by compensating for fluctuations in refrigerant mass flow in the refrigerant circuit. The controller 30 uses the pressure signal from the transducer 20 to calculate a correction factor to shift the voltage output signal from the charge sensor 28 to improve reliability of detection of a reduced refrigerant charge. The correction factor essentially shifts the charge sensor output slightly higher according to a linear function for high side pressures above approximately 200 psi gauge (psig). The higher the pressure above 200 psig, the larger the amount of the shift.

Referring to FIG. 3, each time the charge sensor signal is sampled, determined to be valid, and corrected if necessary, the controller 30 makes a determination as to whether or not the reading is above or below the predetermined low charge set point. A buffer holds the history of these calculations for a predetermined period of time, i.e. 40 to 120 seconds excluding any time the compressor clutch 10 is off or faults are detected. If more than 95% of this or any signal processing history is less than the set point, a low charge detection is made and the appropriate warnings are issued. As illustrated in FIG. 5, the low charge set point is 3.1 volts dc (Vdc).

The detection of a no charge or very low charge condition is similar to the detection of a low charge condition. The major differences are that a different set point is used, and the time period for the history ranges from 30 to 60 seconds. In addition, the clutch 10 is deactivated upon detection of a very low charge state. As illustrated in FIG. 5, the set point for a very low charge condition is 2.7 Vdc. Once the determinations are made as to whether or not low charge and very low charge conditions exist, the controller registers are reset so that the detection procedure can be repeated.

FIG. 4 illustrates a modified form of the detection procedure in which the set points are modified by a decay function calculated each time the refrigeration system is powered up. Thus, the predetermination of the set points occurs prior to operation and at start up, rather than being predetermined for the system in general independently of separate operations thereof, as in the embodiment illustrated in FIG. 3. Once the system has been powered up and the clutch has been verified as being engaged, the controller 30 reads the charge sensor input. The controller 30 then determines a low charge set point, which is a combination of a predetermined value less a computed value. The computed value is determined by an exponential or similar decay function, with its initial value set once the clutch is engaged. The decay function decays to zero over an interval of about ten seconds. It is used to allow for biasing toward making a low charge detection during periods of rapid clutch cycling caused by pressure switches where the state of the refrigerant is in dynamic flux. This feature of predetermining initial set points for each operation of a refrigeration system was originally included in the most preferred embodiment of the invention. It is currently believed that the feature is not necessary in many applications. Overall, the goal of maximizing the simplicity of the system provides more advantage than the use of this feature in most circumstances currently contemplated by the applicant.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. Apparatus for monitoring a refrigerant state in a refrigeration system having an evaporator with an outlet, comprising:

a charge sensor positioned adjacent to the outlet of the evaporator; and a controller electrically connected to said sensor to provide an input signal thereto;

said controller applying, as said input signal, an at least substantially constant voltage to a voltage divider circuit to drive said sensor; said sensor producing a voltage output signal in response to said input signal; and said controller receiving said output signal, processing said output signal, and comparing said output signal to a predetermined set point chosen to correspond to a predetermined refrigerant state.

2. Apparatus according to claim 1, wherein said charge sensor is a self-heated thermistor.

3. Apparatus according to claim 2, wherein said thermistor is positioned adjacent to flow exiting the evaporator through the outlet.

4. Apparatus according to claim 2, wherein said controller compares said output signal to said set point at preset intervals, stores a history of the resulting comparisons for a predetermined time duration, and determines a refrigerant state on the basis of said history.

5. Apparatus according to claim 1, wherein said controller compares said output signal to said set point at preset intervals, stores a history of the resulting comparisons for a predetermined time duration, and determines a refrigerant state on the basis of said history.

6. Apparatus according to claim 5, wherein said controller computes an average of said output signal for said predetermined time duration.

7. Apparatus according to claim 5, wherein said controller determines a percentage of output signal readings that are less than said set point during said predetermined time duration.

8. Apparatus according to claim 3, wherein said controller compares said output signal to said set point at preset intervals, stores a history of the resulting comparisons for a predetermined time duration, and determines a refrigerant state on the basis of said history.

9. Apparatus for detecting a reduced refrigerant charge in a refrigeration system having an evaporator with an outlet, comprising:

a charge sensor positioned adjacent to the outlet of the evaporator; and a controller electrically connected to said sensor to provide an input signal thereto;

said controller applying, as said input signal, an at least substantially constant voltage to a voltage divider circuit to drive said sensor; said sensor producing a voltage output signal in response to said input signal; and said controller receiving said output signal, processing said output signal, and comparing said output signal to a predetermined set point chosen to correspond to a predetermined refrigerant state indicative of a reduced refrigerant charge.

10. Apparatus according to claim 9, wherein said charge sensor is a self-heated thermistor.

11. Apparatus according to claim 10, wherein said thermistor is positioned adjacent to flow exiting the evaporator through the outlet.

12. Apparatus according to claim 11, wherein said controller compares said output signal to said set point at preset intervals, stores a history of the resulting comparisons for a predetermined time duration, and determines a refrigerant state on the basis of said history.

13. Apparatus according to claim 12, wherein said thermistor is positioned about 90° to vertical.

14. Apparatus according to claim 10, wherein said controller compares said output signal to said set point at preset intervals, stores a history of the resulting comparisons for a predetermined time duration, and determines a refrigerant state on the basis of said history.

15. Apparatus according to claim 9, wherein said controller compares said output signal to said set point at preset intervals, stores a history of the resulting comparisons for a predetermined time duration, and determines a refrigerant state on the basis of said history.

16. Apparatus according to claim 10, wherein said controller compares said output signal to a first predetermined set point to determine whether a low charge condition exists and to a second predetermined set point to determine whether a very low charge condition exists.

17. Apparatus according to claim 10, which further comprises a high pressure side pressure transducer, and in which said controller receives a pressure signal from said transducer and uses said pressure signal to calculate a correction factor to shift said voltage output signal to improve reliability of detection of a reduced refrigerant charge.

18. Apparatus according to claim 11, which further comprises a high pressure side pressure transducer, and in which said controller receives a pressure signal from said transducer and uses said pressure signal to calculate a correction factor to shift said voltage output signal to improve reliability of detection of a reduced refrigerant charge.

19. Apparatus according to claim 14, which further comprises a high pressure side pressure transducer, and in which said controller receives a pressure signal from said transducer and uses said pressure signal to calculate a correction factor to shift said voltage output signal to improve reliability of detection of a reduced refrigerant charge.

20. Apparatus according to claim 15, which further comprises a high pressure side pressure transducer, and in which said controller receives a pressure signal from said transducer and uses said pressure signal to calculate a correction factor to shift said voltage output signal to improve reliability of detection of a reduced refrigerant charge.

21. Apparatus according to claim 15, wherein said controller computes an average of said output signal for said predetermined time duration.

22. Apparatus according to claim 15, wherein said controller determines a percentage of output signal readings that are less than said set point during said predetermined time duration.

23. A method of detecting a reduced refrigerant charge in a refrigeration system having an evaporator with an outlet, comprising:

positioning a charge sensor adjacent to the outlet of the evaporator;

electrically connecting said sensor to a controller;

sending an input signal from said controller to said sensor to cause said sensor to produce a voltage output signal, including applying an at least substantially constant voltage to a voltage divider circuit to drive said sensor;

sending said output signal from said sensor to said controller;

in said controller, comparing said output signal to a predetermined set point chosen to correspond to a predetermined refrigerant state indicative of a reduced refrigerant charge.

24. The method of claim 23, wherein said charge sensor is a thermistor.

25. The method of claim 24, wherein positioning said charge sensor comprises positioning said thermistor adjacent to flow exiting the evaporator through the outlet.

26. The method of claim 25, wherein comparing said output signal comprises comparing said output signal to said set point at preset intervals and storing a history of comparisons for a predetermined time duration.

27. The method of claim 24, wherein comparing said output signal comprises comparing said output signal to said set point at preset intervals and storing a history of comparisons for a predetermined time duration.

28. The method of claim 23, wherein comparing said output signal comprises comparing said output signal to said set point at preset intervals and storing a history of comparisons for a predetermined time duration.

29. The method of claim 24, wherein said controller compares said output signal to a first predetermined set point to determine whether a low charge condition exists and to a second predetermined set point to determine whether a very low charge condition exists.

30. The method of claim 25, wherein said controller receives a pressure signal from a transducer positioned in a high pressure side of the refrigeration system and uses said pressure signal to calculate a correction factor to shift said voltage output signal to improve reliability of detection of a reduced refrigerant charge.

31. The method of claim 28, wherein said controller receives a pressure signal from a transducer positioned in a high pressure side of the refrigeration system and uses said pressure signal to calculate a correction factor to shift said voltage output signal to improve reliability of detection of a reduced refrigerant charge.

32. The method of claim 28, wherein said controller computes an average of output signal readings in said history.

33. The method of claim 28, wherein said controller determines a percentage of output signal readings in said history that are less than said set point.

34. An air conditioning system comprising:

a refrigerant circulation circuit including an evaporator with an outlet, a compressor downstream of said outlet, a condenser downstream of the compressor, and an expansion device between the condenser and the evaporator; and apparatus for detecting a reduced refrigerant charge in said circuit, said apparatus including:

a charge sensor positioned adjacent to said outlet of the evaporator; and a controller electrically connected to said sensor to provide an input signal thereto;

said controller applying, as said input signal, an at least substantially constant voltage to a voltage divider circuit to drive said sensor; said sensor producing a voltage output signal in response to said input signal; and said controller receiving said output signal, processing said output signal, and comparing said output signal to a predetermined set point chosen to correspond to a predetermined refrigerant state indicative of a reduced refrigerant charge.

35. A system according to claim 34, wherein said charge sensor is a self-heated thermistor.

36. A system according to claim 35, wherein said thermistor is positioned adjacent to flow exiting the evaporator through the outlet.

37. A system according to claim 36, wherein said controller compares said output signal to said set point at preset intervals, stores a history of the resulting comparisons for a predetermined time duration, and determines a refrigerant state on the basis of said history.

38. A system according to claim 35, wherein said controller compares said output signal to said set point at preset intervals, stores a history of the resulting comparisons for a predetermined time duration, and determines a refrigerant state on the basis of said history.

39. A system according to claim 34, wherein said controller compares said output signal to said set point at preset intervals, stores a history of the resulting comparisons for a predetermined time duration, and determines a refrigerant state on the basis of said history.

40. A system according to claim 34, wherein said controller compares said output signal to a first predetermined set point to determine whether a low charge condition exists and to a second predetermined set point to determine whether a very low charge condition exists.

41. A system according to claim 34, which further comprises a high pressure side pressure transducer, and in which said controller receives a pressure signal from said transducer and uses said pressure signal to calculate a correction factor to shift said voltage output signal to improve reliability of detection of a reduced refrigerant charge.

42. A system according to claim 35, which further comprises a high pressure side pressure transducer, and in which said controller receives a pressure signal from said transducer and uses said pressure signal to calculate a correction factor to shift said voltage output signal to improve reliability of detection of a reduced refrigerant charge.

43. A system according to claim 38, which further comprises a high pressure side pressure transducer, and in which said controller receives a pressure signal from said transducer and uses said pressure signal to calculate a correction factor to shift said voltage output signal to improve reliability of detection of a reduced refrigerant charge.

44. A system according to claim 39, which further comprises a high pressure side pressure transducer, and in which said controller receives a pressure signal from said transducer and uses said pressure signal to calculate a correction factor to shift said voltage output signal to improve reliability of detection of a reduced refrigerant charge.

45. Apparatus for monitoring a refrigerant state in a refrigeration system having an evaporator with an outlet, comprising:

a charge sensor positioned adjacent to the outlet of the evaporator; and a controller electrically connected to said sensor to provide an input signal thereto;

said sensor producing a voltage output signal in response to said input signal; and said controller receiving said output signal, processing said output signal, and comparing said output signal to a predetermined set point chosen to correspond to a predetermined refrigerant state;

wherein said controller compares said output signal to said set point at preset intervals, stores a history of the resulting comparisons for a predetermined time duration, and determines a refrigerant state on the basis of said history.

46. Apparatus according to claim 45, wherein said controller determines whether a reduced refrigerant charge exists, and said predetermined refrigerant state is indicative of a reduced refrigerant charge.

47. Apparatus according to claim 46, wherein said controller computes an average of said output signal for said predetermined time duration.

48. Apparatus according to claim 46, wherein said controller determines a percentage of output signal readings that are less than said set point during said predetermined time duration.

49. An air conditioning system comprising:

a refrigerant circulation circuit including an evaporator with an outlet, a compressor downstream of said outlet, a condenser downstream of the compressor, and an expansion device between the condenser and the evaporator; and apparatus for monitoring a refrigerant state as set forth in claim 46.

50. The method of claim 46, wherein said controller applies an at least substantially constant voltage to a voltage divider circuit to drive said charge sensor.

51. Apparatus according to claim 47, wherein said input signal is at least substantially constant.

52. Apparatus according to claim 22, wherein said controller applies an at least substantially constant voltage to a voltage divider circuit to drive said charge sensor.

53. Apparatus according to claim 46, wherein said controller applies an at least substantially constant current to a circuit interconnecting said controller and said charge sensor.

54. Apparatus according to claim 46, wherein said input signal is a voltage varied to maintain a constant temperature of said thermistor.

55. Apparatus according to claim 46, wherein said controller applies an at least substantially constant voltage to a voltage divider circuit to drive said charge sensor.

56. A method of detecting a reduced refrigerant charge in a refrigeration system having an evaporator with an outlet, comprising:

positioning a charge sensor adjacent to the outlet of the evaporator;

electrically connecting said sensor to a controller;

sending an input signal from said controller to said sensor to cause said sensor to produce a voltage output signal;

sending said output signal from said sensor to said controller;

in said controller, comparing at preset intervals said output signal to a predetermined set point chosen to correspond to a predetermined refrigerant state indicative of a reduced refrigerant charge, storing a history of comparisons for a predetermined time duration, and making a determination of a refrigerant charge level based on said history.

57. The method of claim 56, wherein making said determination comprises computing an average of output signal readings for said predetermined time duration.

58. The method of claim 56, wherein making said determination comprises determining a percentage of output signal readings that are less than said set point during said predetermined time duration.

* * * * *